US011585631B2

(12) United States Patent
Klug et al.

(10) Patent No.: US 11,585,631 B2
(45) **Date of Patent: *Feb. 21, 2023**

(54) PROTECTIVE COVERINGS AND RELATED METHODS FOR ENTANGLING PROJECTILES

(71) Applicant: Wrap Technologies, Inc., Tempe, AZ (US)

(72) Inventors: Scott L Klug, Mesa, AZ (US); Andrew Lin Chiang, Irvine, CA (US); Arik H Jacobson, Mesa, AZ (US)

(73) Assignee: Wrap Technologies, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/504,186

(22) Filed: Oct. 18, 2021

(65) Prior Publication Data

US 2022/0128330 A1 Apr. 28, 2022

Related U.S. Application Data

(63) Continuation of application No. 17/008,217, filed on Aug. 31, 2020, now Pat. No. 11,156,432.

(51) Int. Cl.
*F41B 15/10* (2006.01)
*F41H 13/00* (2006.01)

(52) U.S. Cl.
CPC ..... *F41B 15/10* (2013.01); *F41H 13/0006* (2013.01)

(58) Field of Classification Search
CPC ..... F41H 13/0006; F41B 15/10; F42B 6/00; F42B 12/66
See application file for complete search history.

(56) References Cited

U.S. PATENT DOCUMENTS

| | | | |
|---|---|---|---|
| 34,626 | A | 3/1862 | Ely |
| 34,628 | A | 3/1862 | Gault |
| 35,734 | A | 6/1862 | Gault |
| 39,282 | A | 7/1863 | Ganster |
| 271,825 | A | 2/1883 | Fiske |
| 347,988 | A | 8/1886 | Boyd |
| 1,070,582 | A | 8/1913 | Browning |
| 1,151,070 | A | 8/1915 | Victory |
| 1,198,035 | A | 9/1916 | Huntington |
| 1,211,001 | A | 1/1917 | Steinmetz |

(Continued)

FOREIGN PATENT DOCUMENTS

| | | | |
|---|---|---|---|
| CA | 2162221 | A1 | 5/1996 |
| CN | 104085851 | A | 10/2014 |

(Continued)

*Primary Examiner* — J. Woodrow Eldred
(74) *Attorney, Agent, or Firm* — Jason Jones

(57) ABSTRACT

A grappling assembly for use with an entangling projectile includes at least one hook including an apex portion and a sharpened prong extending distally from the apex portion. A protective cover is positioned adjacent the apex portion of the at least one hook, the protective cover including at least one substantially planar surface. The sharpened prong of the at least one hook extends distally from the protective cover and thereby remaining exposed while the protective cover is positioned adjacent the apex portion of the at least one hook. The at least one hook and the protective cover are formed as an integral unit, or as a continuous, solid piece.

19 Claims, 9 Drawing Sheets

(56) References Cited

U.S. PATENT DOCUMENTS 1,217,415 A 2/1917 Colomyjczuk
1,229,421 A 6/1917 Downs
1,276,689 A 8/1918 Poudrier
1,304,857 A 5/1919 Davis
1,343,747 A 6/1920 Radakovich
1,488,182 A 3/1924 Whelton
1,536,164 A 5/1925 Tainton
2,354,451 A 7/1944 Forbes
2,372,383 A 3/1945 Lee
2,373,363 A 4/1945 Wellcome
2,373,364 A 4/1945 Wellcome
2,455,784 A 12/1948 Lapsensohn
2,611,340 A 9/1952 Manning
2,668,499 A 2/1954 Mourlaque
2,797,924 A 7/1957 Stewart
3,085,510 A 4/1963 Campbell
3,340,642 A 9/1967 Vasiljevic
3,484,665 A 12/1969 Mountjoy et al.
3,583,087 A 6/1971 Huebner
3,717,348 A 2/1973 Bowers
3,773,026 A 11/1973 Romero
3,803,463 A 4/1974 Cover
3,831,306 A 8/1974 Gregg
3,921,614 A 11/1975 Fogelgren
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,466,417 A 8/1984 Mulot et al.
4,559,737 A 12/1985 Washington
4,656,947 A 4/1987 Gordon et al.
4,664,034 A 5/1987 Christian
4,750,692 A 6/1988 Howard
4,752,539 A 6/1988 Vatter
4,912,867 A 4/1990 Dukes, Jr.
4,912,869 A 4/1990 Govett
4,947,764 A 8/1990 Rohr
4,962,747 A 10/1990 Biller
5,003,886 A 4/1991 Pahnke et al.
5,078,117 A 1/1992 Cover
5,103,366 A 4/1992 Battochi
5,145,187 A 9/1992 Lewis
5,279,482 A 1/1994 Dzenitis et al.
5,314,196 A 5/1994 Ruelle
5,315,932 A 5/1994 Bertram
5,326,101 A 7/1994 Fay
5,372,118 A 12/1994 Schmidt, III et al.
5,396,830 A 3/1995 Kornblith et al.
5,460,155 A 10/1995 Hobbs, II
5,561,263 A 10/1996 Baillod
5,649,466 A 7/1997 Genovese
5,654,867 A 8/1997 Murray
5,698,815 A 12/1997 Ragner
5,706,795 A 1/1998 Gerwig
5,750,918 A 5/1998 Mangolds et al.
5,782,002 A 7/1998 Reed
5,786,546 A 7/1998 Simson
5,814,753 A 9/1998 Rieger
5,831,199 A 11/1998 McNulty, Jr. et al.
5,898,125 A 4/1999 Mangolds et al.
5,904,132 A 5/1999 Biller
5,943,806 A 8/1999 Underwood
5,962,806 A 10/1999 Coakley et al.
5,996,504 A 12/1999 Lowery
6,219,959 B1 4/2001 Hsieh
6,283,037 B1 9/2001 Sclafani
6,381,894 B1 5/2002 Murphy
6,382,071 B1 5/2002 Bertani
6,543,173 B1 4/2003 Golan
6,575,073 B2 6/2003 McNulty, Jr. et al.
6,615,622 B2 9/2003 MacAleese et al.
6,636,412 B2 10/2003 Smith
6,729,222 B2 5/2004 McNulty, Jr.
6,820,560 B1 11/2004 Romppanen
6,880,466 B2 4/2005 Carman
6,898,887 B1 5/2005 Stratbucker
7,042,696 B2 5/2006 Smith et al.
7,065,915 B2 6/2006 Chang
7,075,770 B1 7/2006 Smith
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,360,489 B1 4/2008 Han et al.
D570,948 S 6/2008 Cerovic et al.
7,409,912 B2 8/2008 Cerovic et al.
7,412,975 B2 8/2008 Dillon, Jr.
7,444,939 B2 11/2008 McNulty et al.
7,444,940 B2 11/2008 Kapeles et al.
D602,109 S 10/2009 Cerovic et al.
7,640,839 B2 1/2010 McNulty, Jr.
7,640,860 B1 1/2010 Glover et al.
7,673,411 B1 3/2010 Baldwin
7,686,002 B2 3/2010 Andrews
7,778,005 B2 8/2010 Saliga
7,791,858 B2 9/2010 Hummel et al.
7,856,929 B2 12/2010 Gavin et al.
7,859,818 B2 12/2010 Kroll et al.
7,900,388 B2 3/2011 Brundula et al.
7,905,180 B2 3/2011 Chen
7,950,176 B1 5/2011 Nemtyshkin et al.
7,950,329 B1 5/2011 Nemtyshkin et al.
7,984,676 B1 7/2011 Gavin et al.
8,015,905 B2 9/2011 Park
8,024,889 B2 9/2011 Bunker
8,082,199 B2 12/2011 Kwok
D651,679 S 1/2012 Klug et al.
8,096,076 B1 1/2012 Cerovic et al.
8,141,493 B1 3/2012 Kuchman
8,186,276 B1 5/2012 Olden et al.
8,231,474 B2 7/2012 Stethem
8,245,617 B2 8/2012 Martinez et al.
8,261,666 B2 9/2012 Garg
8,281,776 B2 10/2012 Körver et al.
8,339,763 B2 12/2012 McNulty, Jr.
8,441,771 B2 5/2013 Hinz et al.
8,547,679 B2 10/2013 Gavin
8,561,516 B2 10/2013 Martinez et al.
8,601,928 B2 12/2013 Martinez et al.
8,671,841 B2 3/2014 Raquin et al.
8,695,578 B2 4/2014 Olden et al.
8,677,675 B2 5/2014 Koch
8,757,039 B2 6/2014 Martinez et al.
8,857,305 B1 10/2014 Tseng
8,881,654 B2 11/2014 Seecamp
8,896,982 B2 11/2014 Beechey et al.
8,899,139 B2 12/2014 Brill et al.
9,025,304 B2 5/2015 Brundula et al.
D736,885 S 8/2015 Swan et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,335,119 B2 5/2016 Werner
9,414,578 B2 8/2016 Thornbrough
9,581,417 B2 2/2017 Tseng
9,638,498 B2 5/2017 Chang
D791,901 S 7/2017 Swan et al.
10,107,599 B2 10/2018 Norris et al.
10,288,388 B1 5/2019 Lavin et al.
10,408,588 B1 * 9/2019 Manley ..... F42B 14/064
10,731,698 B2 8/2020 Chmelar
2002/0134365 A1 9/2002 Gray
2002/0170418 A1 11/2002 McNulty Jr. et al.
2003/0106415 A1 6/2003 Smith
2003/0165041 A1 9/2003 Stethem
2003/0165042 A1 9/2003 Stethem
2004/0245338 A1 12/2004 Poloniewicz
2005/0073161 A1 4/2005 Philbin
2005/0166441 A1 8/2005 Mattox

(56) References Cited

U.S. PATENT DOCUMENTS

| | | | |
|---|---|---|---|
| 2006/0112574 | A1 | 6/2006 | Hodge et al. |
| 2006/0120009 | A1 | 6/2006 | Chudy, II |
| 2006/0254108 | A1 | 11/2006 | Park |
| 2007/0019358 | A1 | 1/2007 | Kroll |
| 2007/0079538 | A1 | 4/2007 | Smith et al. |
| 2007/0081292 | A1 | 4/2007 | Brundula et al. |
| 2007/0081293 | A1 | 4/2007 | Brundula et al. |
| 2007/0101893 | A1 | 5/2007 | Shalev et al. |
| 2007/0188972 | A1 | 8/2007 | Nerheim et al. |
| 2007/0264079 | A1 | 11/2007 | Martinez et al. |
| 2008/0204965 | A1 | 8/2008 | Brundula et al. |
| 2008/0259520 | A1 | 10/2008 | Brundula |
| 2009/0025597 | A1 | 1/2009 | Kapeles et al. |
| 2009/0084284 | A1 | 4/2009 | Martinez et al. |
| 2009/0323248 | A1 | 12/2009 | Brundula et al. |
| 2010/0126483 | A1 | 5/2010 | Makowski |
| 2010/0315755 | A1 | 12/2010 | Gavin |
| 2010/0315756 | A1 | 12/2010 | Gavin |
| 2011/0005373 | A1 | 1/2011 | Martinez et al. |
| 2011/0271825 | A1 | 11/2011 | Howland |
| 2012/0019975 | A1 | 1/2012 | Hanchett et al. |
| 2012/0170167 | A1 | 7/2012 | Beechey et al. |
| 2012/0210904 | A1 | 8/2012 | Merems |
| 2012/0257320 | A1 | 10/2012 | Brundula et al. |
| 2013/0208392 | A1 | 8/2013 | Brundula et al. |
| 2014/0216290 | A1 | 8/2014 | Yee et al. |
| 2014/0331984 | A1 | 11/2014 | Brahler, II et al. |
| 2014/0334058 | A1 | 11/2014 | Galvan et al. |
| 2015/0067968 | A1 | 3/2015 | Eckert |
| 2015/0075073 | A1 | 3/2015 | Sylvester |
| 2015/0168107 | A1 | 6/2015 | Tseng |
| 2015/0241180 | A1 | 8/2015 | Pruett |
| 2015/0276351 | A1 | 10/2015 | Pekarek et al. |
| 2015/0316345 | A1 | 11/2015 | Brahler, II et al. |
| 2016/0010949 | A1 | 1/2016 | Teetzel et al. |
| 2016/0161225 | A1 | 6/2016 | Searle et al. |
| 2016/0238350 | A1 | 8/2016 | Tseng |
| 2017/0029816 | A1 | 2/2017 | Swiderski |
| 2017/0160060 | A1 | 6/2017 | Purvis |
| 2017/0241751 | A1 | 8/2017 | Nerheim |
| 2017/0276460 | A1 | 9/2017 | Norris et al. |
| 2017/0276461 | A1 | 9/2017 | Norris et al. |
| 2018/0003462 | A1 | 1/2018 | Chavez |
| 2018/0094908 | A1 | 4/2018 | Down et al. |
| 2018/0292172 | A1 | 10/2018 | Ehrlich |
| 2018/0335779 | A1 | 11/2018 | Fisher et al. |
| 2019/0186872 | A1 | 6/2019 | Salisbury et al. |
| 2019/0186873 | A1 | 6/2019 | Salisbury et al. |
| 2019/0271772 | A1 | 9/2019 | Nerheim et al. |
| 2020/0109924 | A1 | 4/2020 | Goodchild et al. |

FOREIGN PATENT DOCUMENTS

| | | | |
|---|---|---|---|
| DE | 3522661 | A1 | 1/1987 |
| GB | 2386673 | A | 9/2003 |
| JP | 2011/106748 | A | 6/2011 |
| RU | 2186492 | C2 | 8/2002 |
| RU | 2274823 | C1 | 4/2006 |
| RU | 2410625 | C2 | 1/2011 |

* cited by examiner

PROTECTIVE COVERINGS AND RELATED METHODS FOR ENTANGLING PROJECTILES

PRIORITY CLAIM

This is a continuation of U.S. patent application Ser. No. 17/008,217, filed Aug. 31, 2020, which is hereby incorporated herein by reference in its entirety.

BACKGROUND OF THE INVENTION

Field of the Invention

The present invention relates generally to protective devices to minimize or eliminate unintended injury to subjects targeted by non-lethal, ranged detainment weapons.

Related Art

It has been recognized for some time that police and military personnel can benefit from the use of weapons and devices other than firearms to deal with some hostile situations. To address this need, the present inventor developed a commercially successful product known as the Bolawrap. This device, and others developed by the present applicant, have allowed law enforcement personnel to address potentially dangerous situations without resorting to the use of a firearm, and without engaging in hand-to-hand combat.

This type of launching system generally utilizes a projectile that includes a tether and a pair of pellets carried at ends of the tether. The projectile is directed toward a subject and, once the tether contacts the subject, the pellets circumnavigate the subject and cause the projectile to wrap about the subject. This results in the subject's movements being sufficiently restricted to allow authorities to approach the subject safely. While these systems have enjoyed phenomenal success, the present inventor has continued to develop technology to even further improve the safety of such devices.

SUMMARY OF THE INVENTION

In accordance with one aspect of the invention, a grappling assembly for use with an entangling projectile is provided, the grappling assembly including at least one hook including an apex portion and a sharpened prong extending distally from the apex portion. A protective cover can be positioned adjacent the apex portion of the at least one hook, the protective cover including at least one substantially planar surface. The sharpened prong of the at least one hook can extend distally from the protective cover and thereby remaining exposed while the protective cover is positioned adjacent the apex portion of the at least one hook. The at least one hook and the protective cover can be formed as a continuous, solid piece.

In accordance with another aspect of the technology, a grappling assembly for use with an entangling projectile is provided, the grappling assembly including at least one hook including an apex portion and a sharpened prong extending distally from the apex portion. A protective cover can be positioned adjacent the apex portion of the at least one hook, the protective cover including a substantially flat contact surface. The protective cover can be positioned relative to the at least one hook such that the sharpened prong of the at least one hook extends distally from the protective cover and thereby remains exposed relative to the protective cover. A first pellet can be coupled to a tether: the at least one hook can be coupled to the first pellet. The at least one hook, the first pellet and the protective cover can be formed integrally with one another.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
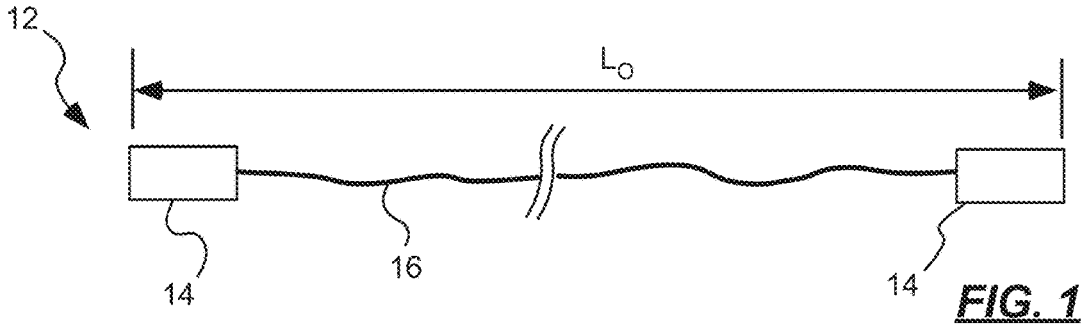
FIG. 1 is a top, bottom, front or rear view of a generic entangling projectile extended substantially to its full length in accordance with an embodiment of the invention.
Figure 2A:
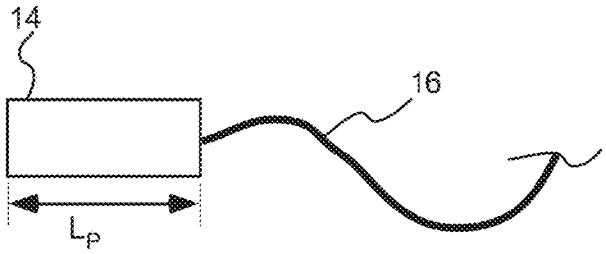
FIG. 2A is a side view of a generic pellet and a portion of a tether of the projectile of FIG. 1.
Figure 2B:
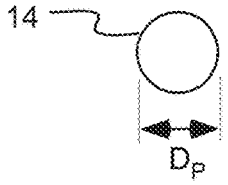
FIG. 2B is an end view of the pellet of FIG. 2A.
Figure 3A:
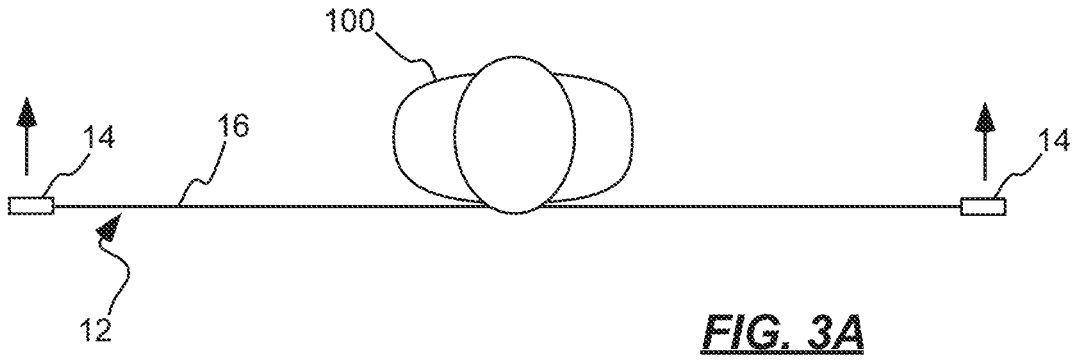
FIG. 3A is a top view of a subject toward which an entangling projectile was launched, shown immediately prior to the entangling projectile engaging the subject.
Figure 3B:
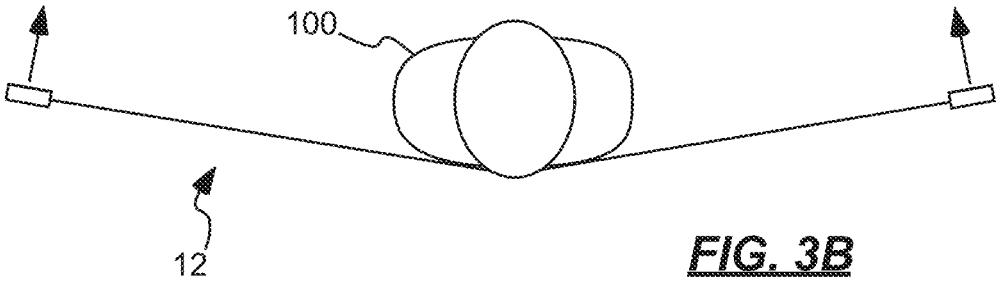
FIG. 3B is a top view of the subject and projectile of FIG. 3A, shown shortly after the entangling projectile engaged the subject.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a hook" can include one or more of such hooks, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

Figure 5:
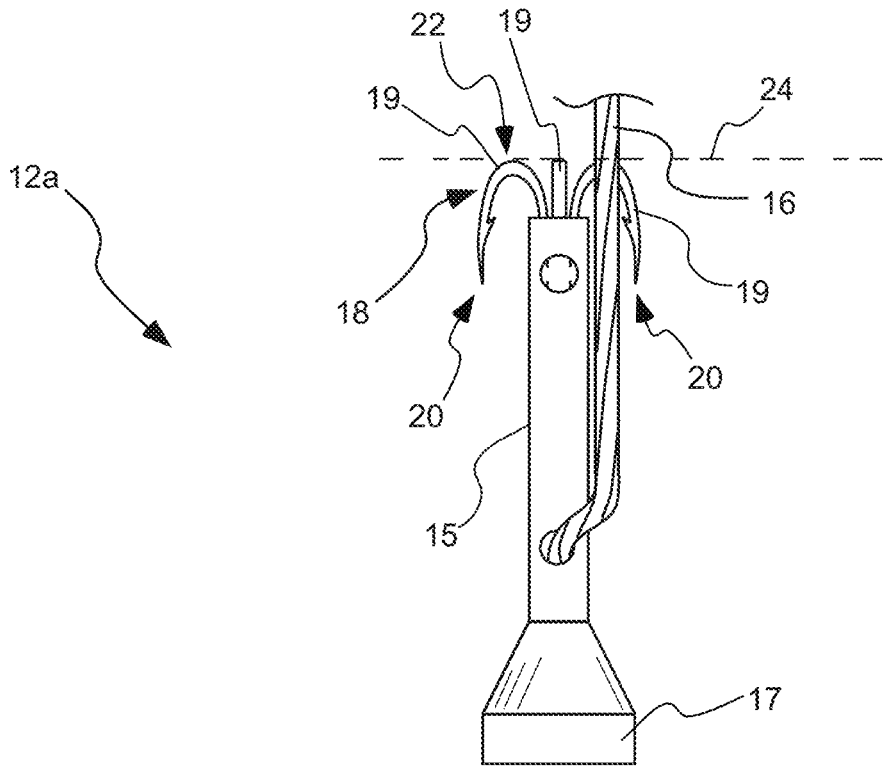
FIG. 5 is a front view of a portion of an entangling projectile in accordance with another embodiment of the invention.
Figure 12:
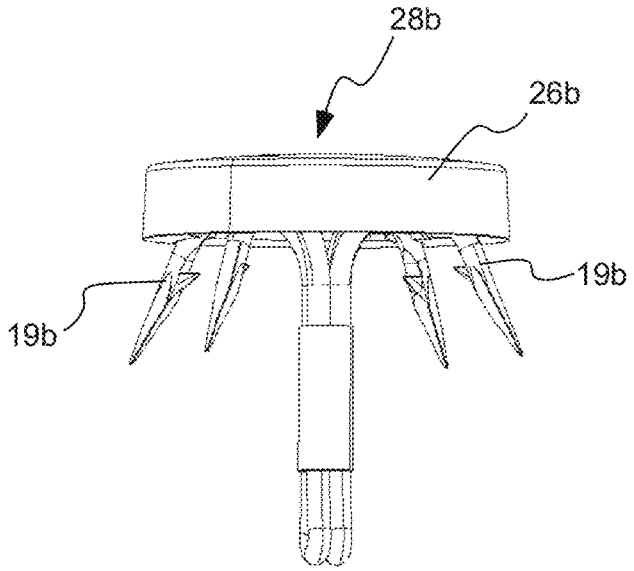
FIG. 12 is a side view of a grappling assembly with a protective cover in accordance with another embodiment of the invention.
Figure 13:
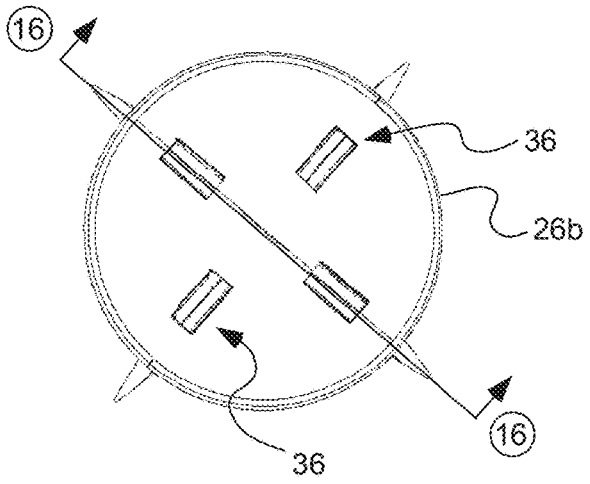
FIG. 13 is a top view of the assembly of FIG. 12.
Figure 14:
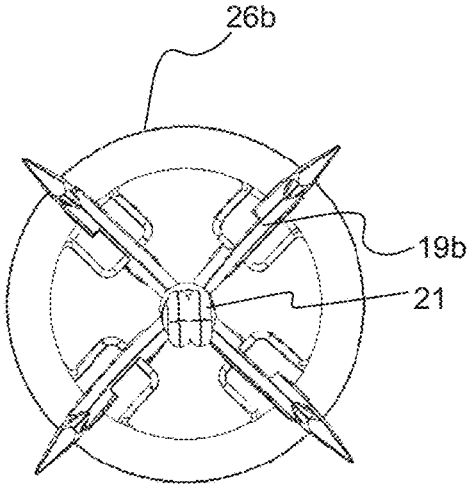
FIG. 14 is a bottom view of the assembly of FIG. 12.
Figure 15:
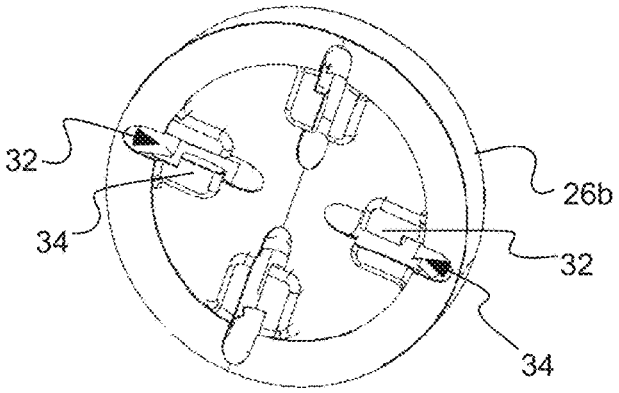
FIG. 15 is a bottom perspective view of the protective cover of FIG. 12.
Figure 16:
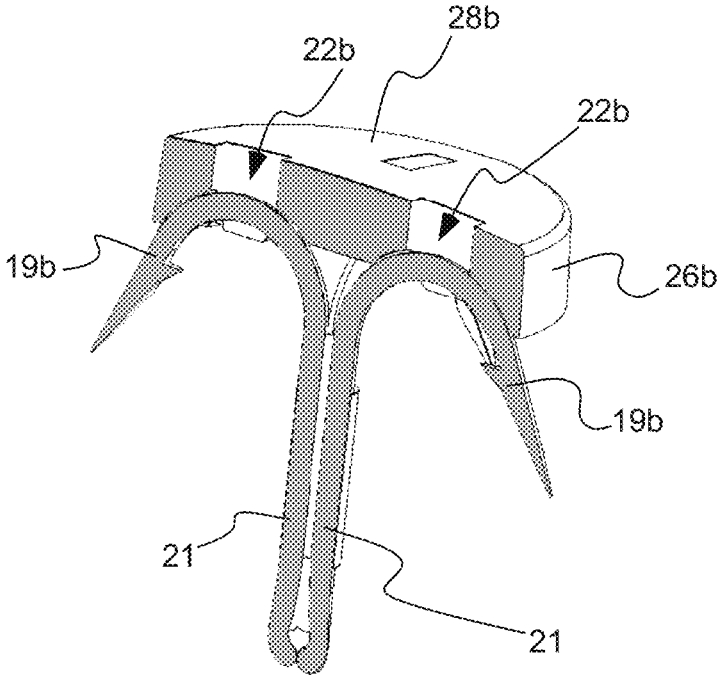
FIG. 16 is a sectional view of the assembly of FIG. 12, taken along section 16-16 of FIG. 13.
Figure 17:
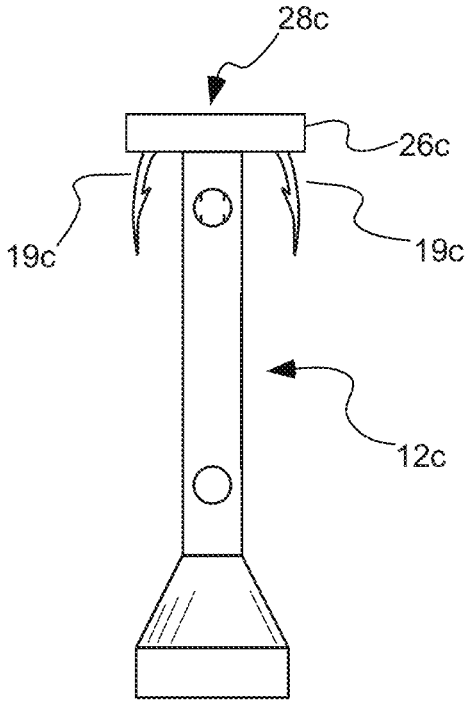
FIG. 17 is a side view of a grappling assembly with a protective cover in accordance with another embodiment of the invention.

When specific reference is made herein to terms such as "vertical" or "upwardly" or "downwardly," reference is generally made as if a pellet or hook assembly is held in the orientation shown for example in FIGS. 5, 12 and 17. In this case, the bottom or base or "head" of the pellet and/or hook assembly is positioned in a lowermost elevation, with the hooks or points or "tail" of the assembly oriented at a higher elevation. Thus, in this case, the base of the assembly is generally vertically lower than the sharpened portions of the individual hooks.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates broadly to components used in non-lethal weapons systems, sometimes referred to as ensnarement or entanglement systems, that can be effectively used as an aid in impeding the movement of or detaining aggressive or fleeing subjects. Devices in accordance with the present technology can be advantageously used to temporarily impede a subject's ability to walk, run, or use his or her arms in cases where law enforcement, security personnel or military personnel wish to detain a subject, but do not wish to use lethal or harmful force or to engage in close proximity, hand-to-hand combat. The technology provides a manner by which the arms or legs of a subject can be temporarily tethered or bound, to the extent that the subject finds it difficult to continue moving in a normal fashion.

While the present technology can be directed at any portion of a subject's body, the following discussion will focus primarily on use of the technology to temporarily tether or bind a subject's legs. It is to be understood, however, that the present technology is not limited to this application. In some cases, multiple portions of the subject's body can be targeted, such as both the arms and the legs.

As shown generally in FIGS. 1-5, the present technology provides an entangling projectile 12 that can be deployed toward a subject's legs to cause the projectile to wrap about the subject's legs. The projectile includes at least one flexible tether 16 and at least two pellets 14 (sometimes referred to as anchors), coupled together by the tether. By engaging a subject with the entangling projectile, the subject is temporarily rendered partially or fully incapacitated and thereby restricted in his or her ability to flee or attack. The entangling projectiles of the present technology are launched toward a subject (100 in FIGS. 3A through 4) by a launcher. In addition to the launchers discussed herein, numerous examples of suitable launchers are provided, as examples, in the above-referenced parent case, U.S. patent application Ser. No. 15/081,440, filed Mar. 25, 2016, which is hereby incorporated herein by reference in its entirety. Such launchers can include energy sources such as compressed gas, explosives/combustibles, mechanical springs, electrical and/or magnetic systems, etc.

Generally speaking, a launcher for use with the present entangling projectiles will launch the projectile toward a subject 100 at a relatively high rate of speed. Typically, the projectile can be deployed toward a subject from a distance of between about 6 feet and about 30 feet (1.8 to 9.1 meters), and engages the subject within a matter of about 0.0075 to 0.0375 seconds (traveling at about 800 ft/sec (243.8 m/s)). After being deployed from the launcher, the entangling projectile will wrap about the subject's legs two or three or more times, causing the subject to be temporarily unable to effectively move. As the entangling projectile can be launched from some distance, law enforcement personnel can maintain a safe distance from a subject, yet still be able to effectively and safely temporarily restrain, disable or impede the subject.

Figure 4:
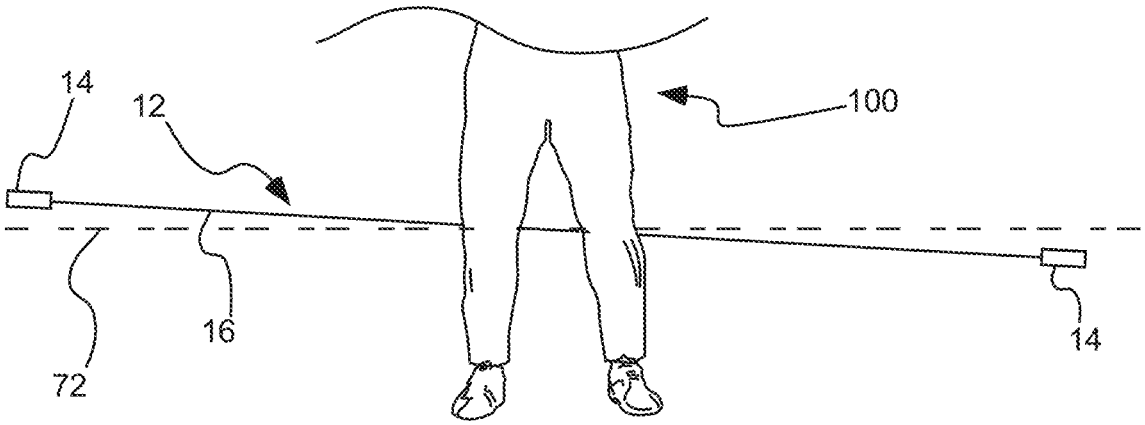
FIG. 4 is a front view of a portion of a subject in accordance with an embodiment of the invention, shown immediately prior to an entangling projectile engaging the subject's legs.

Operation of the entangling projectile is shown generally in FIG. 4: after being released by a launcher, the projectile 12 travels toward a subject 100. As the projectile travels toward the subject, pellets 14 travel away from one another, resulting in the tether 16 being pulled substantially taught between the two. Once the projectile engages the subject (in the example shown in FIG. 4 the subject's legs are engaged), the pellets and tether wrap about the subject and thereby temporarily entangle and/or disable the subject.

A variety of differing pellet and tether combinations can be utilized in the present technology. In the examples shown in FIGS. 1-4, the projectile 12 is shown with two generic pellets or anchors 14 connected by a single tether 16. While more than two pellets can be utilized, the examples shown herein include only two. In some embodiments, the invention is limited to two, and only two, pellets connected by a single tether. In one aspect, the invention consists of two pellets and a single tether. In one aspect, the invention consists essentially of two pellets and a single tether. It has been found that limiting the number of pellets to two results in a more effective deployment system: the risk of tangling of the tether 16 is diminished and the pellets spread apart from one another much more cleanly and quickly after being deployed from the launcher. This results in a more consistent trajectory after deployment. This arrangement can also allow, with the proper launcher configuration, the projectiles to be more accurately directed toward a subject.

FIG. 1 illustrates the projectile 12 extended to its full length "$L_O$." In one embodiment, the overall length of the tether is much longer than the size of pellets ($L_P$). The overall length can be on the order of seven feet (2.14 meters) or greater. The pellets can have a length "$L_P$" on the order of an inch (2.54 cm), and a diameter "$D_P$" on the order of ⅜ of an inch (0.95 cm). While differing embodiments of the technology can vary, it is generally desirable to maintain the pellets at a relatively small size to thereby limit the overall size requirements of the projectile casing that houses the pellets prior to deployment and to reduce the impact should a pellet hit the subject. In this manner, the technology can be provided in a lightweight, hand-held device.

FIG. 5 illustrates a portion of one exemplary entangling projectile 12*a* in accordance with an embodiment of the invention. In this example, pellet 14*a* is provided that includes various features that aid in more accurately and effectively engaging a subject. For example, a hook or grappling assembly 18 can be attached atop a shank 15 of the pellet, and can be secured to the shank in a variety of appropriate manners. The hook assembly can include one or more individual hook components 19. In the examples shown, multiple individual hook components are provided, with four being the most commonly employed arrangement. It is to be understood, however, that the present technology can be employed with hook assembly have one to several individual hook components. To simplify the discussion herein, the end of the pellet to which the hook assembly is attached will be referred to as the "tail" end of the pellet, with an opposing end 17 being considered the "head" end of the pellet.

The hook assembly 18 shown has been shown to enhance the ability of the projectile to successfully wrap about a subject. The individual hook components do not engage the subject directly, but rather engage portions of the subject's clothing after the pellets and tether have wrapped about the subject. This limits the tendency of the projectile to "unwrap" as the subject struggles against the wrap. As is inherent in the present design, the pellets and/or hook assemblies are not intended to be directly fired at a subject. They must, by design, travel beyond the subject to enable a successful wrap. If the pellets directly contact a user, the engagement of the subject will be unsuccessful. Thus, it is never the case that the pellet is intentionally aimed directly at the subject.

While this design functions very well when the projectile is deployed as designed, there remains a slight risk that something can go awry during deployment of the projectile. For example, an outside party may suddenly enter the line of fire as the launcher deploys the projectile toward a subject, or the wielder of the launcher may have his or her aim negatively affected by an outside force. In this case, it is possible that the pellet will directly contact the subject. If this happens, there is a risk that the upper portions of the hook assembly can penetrate a subject's skin and cause damage to the subject. As is shown, for example, in FIG. 5, while these upper or apex portions 20 (discussed in further detail below) of the individual hook components are not sharpened, as that term is generally used, they present a sufficiently small surface area that the force of the pellet as it travels from the launcher can result in these upper portions being embedded into a subject or an unintended target.

Figure 6A:
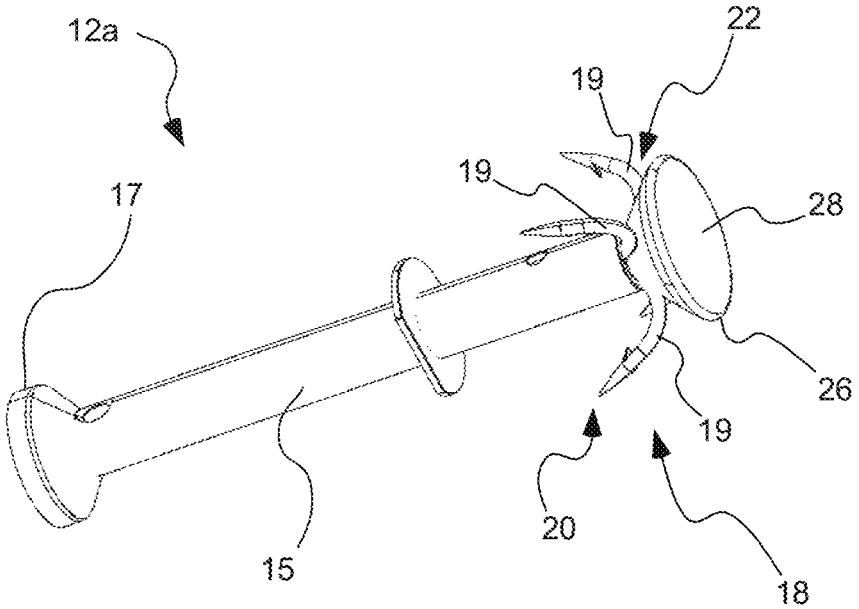
FIG. 6A is a perspective view of a pellet and grappling assembly in accordance with another embodiment of the invention.
Figure 6B:
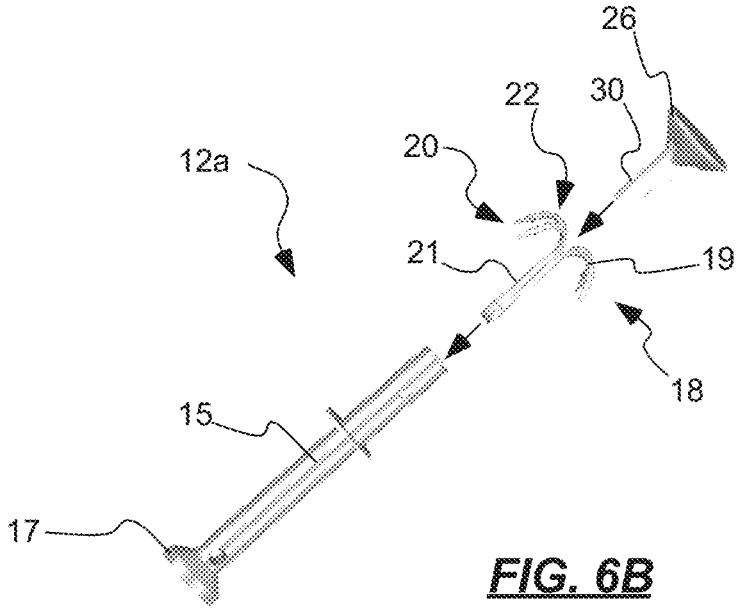
FIG. 6B is an exploded perspective view of the pellet and grappling assembly of FIG. 6A.
Figure 7:
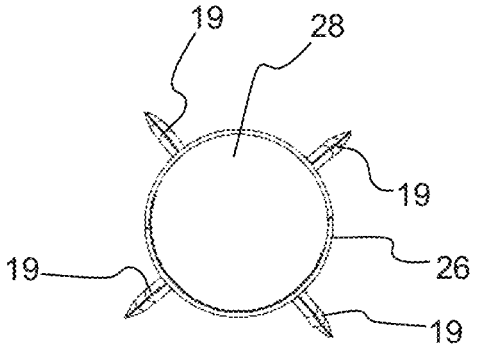
FIG. 7 is a top end view of the assembly of FIG. 6A.

The present technology addresses this potential problem by providing a protective cover or cap that better distributes the impact force resulting from a hook assembly inadvertently contacting a subject. This is accomplished while not at all interfering with the normal operation of the hook assembly. Exemplary embodiments of this aspect of the technology are shown in FIGS. 6A-18. As best seen in FIGS. 6A and 6B, in one aspect, a grappling assembly 18 can be provided that includes one or more individual hook components 19 carried by a pellet 12*a* that can include a head portion 17. The one or more individual hooks can include an apex portion 22 and a sharpened prong 20 extending distally from the apex portion.

The apex portions 22 of the plurality of individual hooks 19 can collectively define an apex portion contact profile, defined as the portions of the hooks that first contact a plane, for example, plane 24 in FIG. 5. As one of ordinary skill in the art will readily appreciate, the smaller the collective cross section of the apex portions, the more readily the hook assembly will penetrate the skin of a subject if the apex portion contact profile impacted the subject with great speed. The apex portion contact profile can also include a curvature. If the apex portions of the individual hooks were less curved than the example shown, the hooks would be less likely to penetrate the skin of a subject in the event of contact. If the hooks were more sharply curved, the apex portions would be more likely to penetrate the skin of a subject. By increasing the surface area of this contact profile of the assembly as a whole, or by decreasing the curvature of this contact profile, the grappling assembly is less likely to penetrate the skin of a subject, and thus less likely to cause significant injury to the subject.

Figure 8:
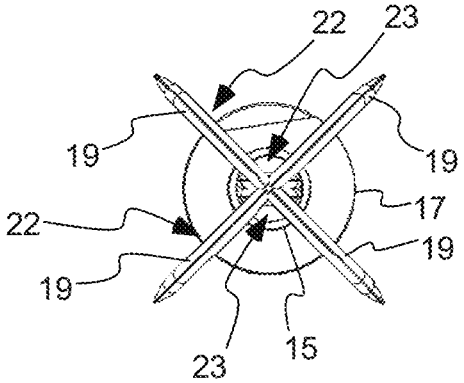
FIG. 8 is a top end view of the assembly of FIG. 7, with a protective covering removed to enable viewing of the individual hooks.
Figure 9:
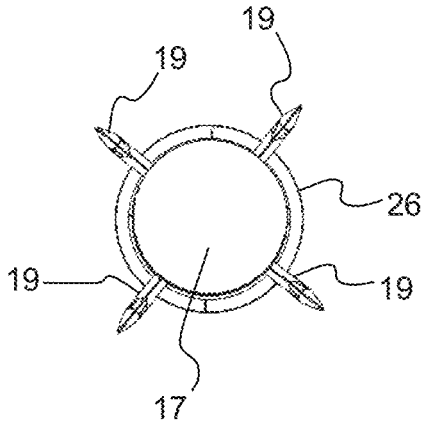
FIG. 9 is a bottom end view of the assembly of FIG. 6A.
Figure 10:
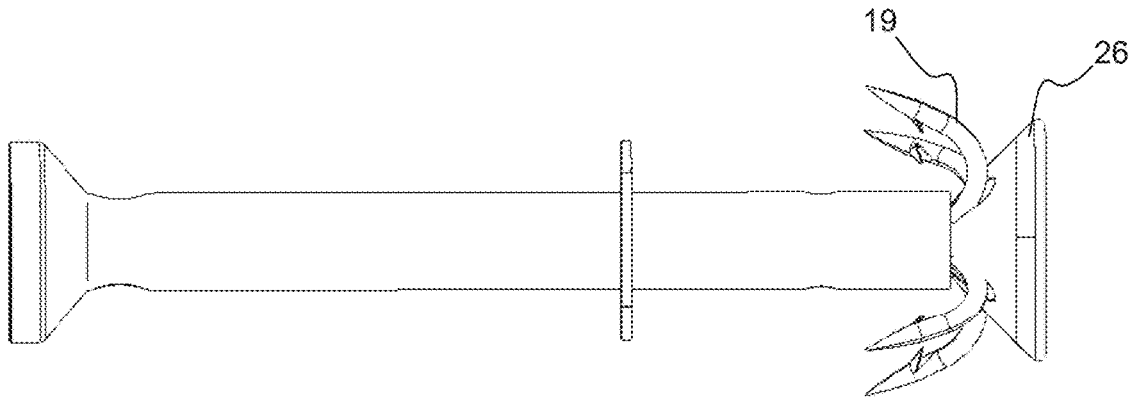
FIG. 10 is a side view of the assembly of FIG. 6A.

One manner in which the present technology accomplishes this is by providing a protective cover or cap 26, shown in FIGS. 6A, 6B, 7, 9, 10 and 11 (note that the protective cover is omitted from FIG. 8 to more clearly illustrate the apex portions of the hooks). The protective cover can be carried adjacent (generally atop) the apex portions of the one or more hooks and can include at least one substantially continuous, or planar surface 28. By increasing either or both the cross-sectional area of the surface 28, or by decreasing the curvature of the surface, relative to the apex portions of the individual hooks, the tendency of the grappling assembly to penetrate the skin of a subject is greatly reduced. In the examples shown, the substantially continuous surface 28 includes a generally flat plane. However, it is to be understood that a slightly curved plane can also be provided. The surface can be a substantially continuous unit of material, or can include openings, through-holes and various geometric features, such as fingers, webbing, etc.

The protective cover 26 or cap can be positioned relative to the one or more hooks 19 such that the sharpened prongs 20 of the hooks extend distally from the protective cover. In this manner, the sharpened prongs remain exposed to operate normally while the protective cover is carried by the apex portion of the at least one hook. Thus, even with the protective cover in place, the sharpened prongs will serve to engage the clothing of a subject to aid, as designed, in maintaining the projectile wrapped about the subject.

The protective cover 26 can be carried by the hooks 19, pellet 12*a* and/or grappling assembly 18, etc., in a number of manners. For example, the protective cover can be attachable or coupleable to the pellet or hooks using a variety of permanent or removable attachment mechanisms. As best seen in FIG. 6B, each of the plurality of hooks 19 can include a shank portion 21 that can extend distally from the apex portion 22. The shank portion of the hooks can be received within a hollow section of a shank portion 15 of the pellet. In some embodiments, the plurality of shank portions can collectively define a receiving chamber, and a shank portion of the protective cover can be receivable within the receiving chamber formed by the shank portions.

Figure 11:
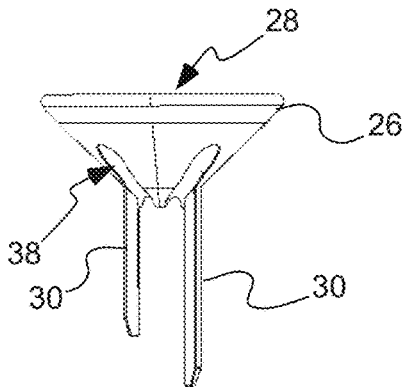
FIG. 11 is a side view of a protective cover of the assembly of FIG. 6A.

For example, in the embodiment illustrated in FIG. 8, the shank portions 21 of the hooks 19 and the hollow section of the shank portion 15 of the pellet can collectively define a series of receiving chambers 23 within which shanks 30 (FIG. 11) of the protective cover can be received. The shanks can be removably held within the receiving chamber by a friction fit, or can be permanently attached therein with adhesives, welds, etc. As shown in FIG. 11, the protective cover 26 can include two or more shanks 30, having similar or dissimilar lengths, cross-sectional areas, etc. The protective cover can also include grooves or slots 38 (FIG. 11) to prevent relative motion between the protective cover and the hooks.

FIGS. 12-16 illustrate an embodiment of the technology in which a protective cover 26*b* is secured atop apex portions 22*b* of hooks 19*b* via a series of receiving slots 32 formed in the protective cover. Each of the receiving slots can receive therein an apex portion (22*b* in FIG. 16) of one of the plurality of hooks. One or more retaining clips 34 (FIG. 15) can be associated with the receiving slots. The retaining clips can be operable to removably secure the apex portion within the receiving slot. In this manner, the protective cap 26*b* can be snap-fit over the apex portions of the hooks to provide a protective surface thereover. Openings 36 (FIG. 13) can be formed through the protective cover to provide visual or physical access to the apex portions of the hooks once the protective cover is in position thereupon.

Figure 18:
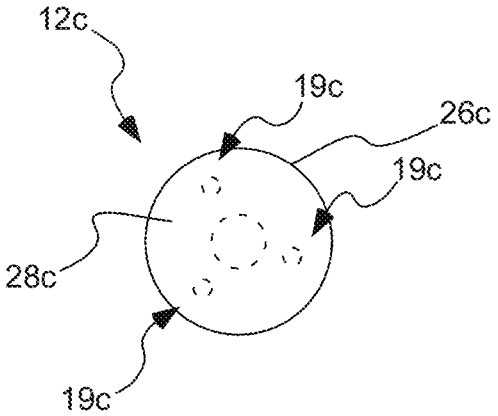
FIG. 18 is a top view of the assembly of FIG. 17.

In the example shown in FIGS. 17 and 18, a grappling assembly 12*c* is shown in which a protective cover 26*c* is mated with one or more hooks 19*c*. The protective cover can include a substantially planar surface 28*c*. In this example, the hooks 19*c* can extend distally away from the protective cover in the same manner as discussed in previous embodiments. However, in this example, the hooks 19*c* do not include shank portions, or curved upper apex portions. Instead, the hooks can be mated with the protective cover to provide a uniform assembly. The protective cover and hooks can be formed as a continuous, solid piece, or the hooks can be welded, bonded, etc., securely to the protective cover. The diameter of the protective cover can vary, and in some embodiments (FIGS. 17 and 18, for example) is equal to or greater than an outside diameter of the hook assembly 18, or can be smaller in diameter, as shown in FIGS. 6A-16.

Figure 19:
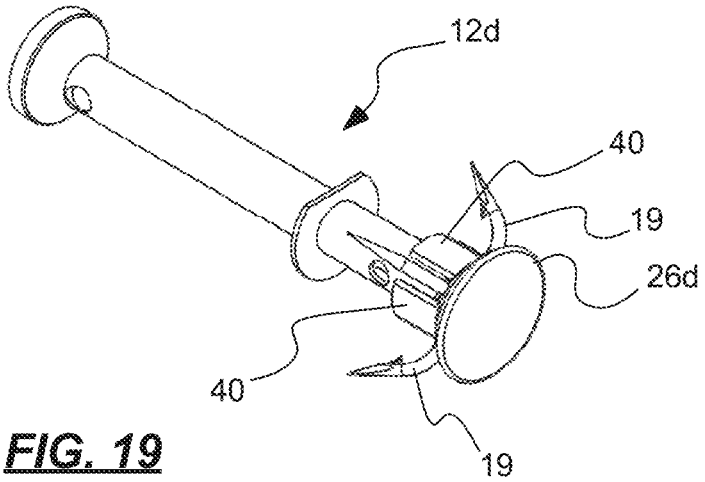
FIG. 19 is a perspective view of a grappling assembly with a protective cover in accordance with another embodiment of the invention.
Figure 20:
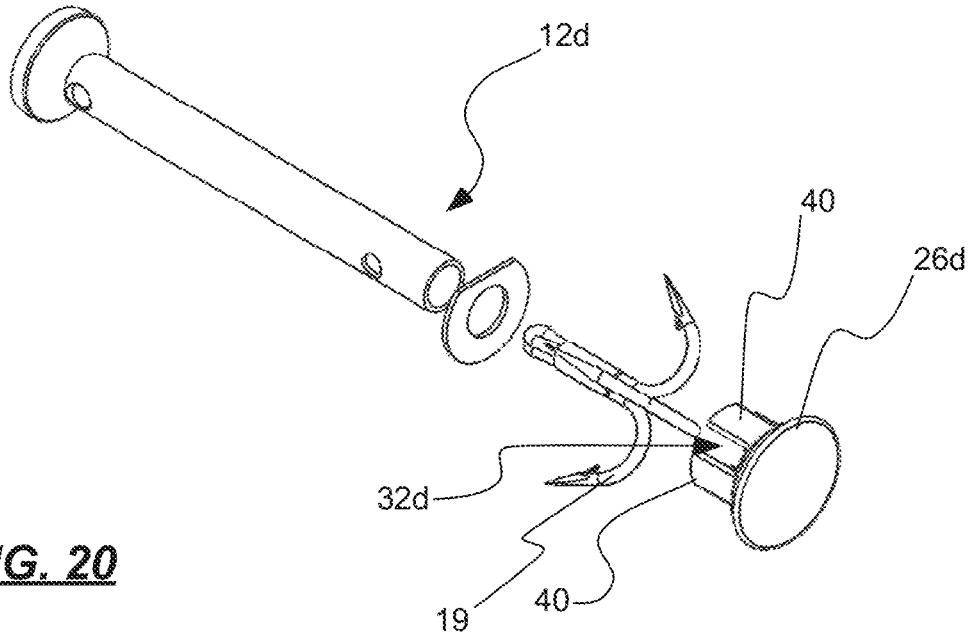
FIG. 20 is an exploded, perspective view of the assembly of FIG. 19.

FIGS. 19 and 20 illustrate another embodiment of the technology in which grappling assembly 12*d* includes a protective cover 26*d*. The protective cover can include a plurality of shoulders 40 that extend from a substantially planar surface 28*d*. The shoulders can define one or more receiving slots 32*d* within which the hooks 19 can be received. This configuration can advantageously reduce any tendency the protective cover and hook assembly may have to rotate relative to one another. The extended length of the receiving slots can also more securely engage the hooks to eliminate or reduce the need for adhesive or other attachment mechanism between the hooks and the protective cover.

The protective covers of the present technology can be formed from a variety of materials, including without limitation, polymers, metals, composites, etc. By forming the covers from a lightweight material such as a polymer, the ballistic properties of the pellet assembly are not significantly affected. In those cases in which the protective cover is removably attached to the grappling assembly, an operator or manufacturer can easily adapt known grappling assemblies to incorporate therein the safety features of the present technology.

In addition to the structure outlined above, the present technology also provides a method of providing a protective covering to a grappling assembly. The grappling assembly can include a plurality of hooks, each of the plurality of hooks having an apex portion and a sharpened prong extending distally from the apex portion. The method can include positioning a protective relative to the apex portions of the plurality of hooks. The protective cover can include at least one substantially continuous surface. The method can include positioning the protective cover relative to the at least one hook such that the sharpened prong of the at least one hook extends distally from the protective cover and thereby remains exposed while the protective cover is carried by the plurality of hooks. The method can include fixing the protective cover in position relative to the plurality of hooks.

Fixing the protective cover in position can include removably attaching the protective cover in position relative to the apex portions of the plurality of hooks.

Each of the plurality of hooks can include a shank portion, extending distally from the apex portion, the shank portions collectively defining a receiving chamber. The protective cover can include a shank portion. Fixing the protective cover in position can include positioning the shank portion of the protective cover within the receiving chamber formed by the shank portions.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

The invention claimed is:

1. A grappling assembly for use with an entangling projectile, the grappling assembly comprising:

at least one hook including an apex portion and a sharpened prong extending from the apex portion; and a protective cover, positioned adjacent the apex portion of the at least one hook, the protective cover including at least one substantially planar surface;

the sharpened prong of the at least one hook extending distally from the protective cover and thereby remaining exposed while the protective cover is positioned adjacent the apex portion of the at least one hook;

the at least one hook and the protective cover being formed as a continuous piece.

2. The assembly of claim 1, wherein the at least one hook has a cross-sectional area at the apex portion, and wherein the substantially planar section of the protective cover includes a cross-sectional area greater than the cross-sectional area of the apex portion of the at least one hook.

3. The assembly of claim 1, further comprising a plurality of hooks, each of the plurality of hooks having an apex portion, the protective cover positioned adjacent each apex portion of each of the plurality of hooks.

4. The assembly of claim 3, wherein each of the plurality of hooks has a cross-sectional area at the apex portion, and wherein the substantially planar section of the protective cover includes a cross-sectional area greater than a combined cross-sectional area of the apex portions of the plurality of hooks.

5. The assembly of claim 1, wherein the at least one hook has a hook curvature, and wherein the substantially planar section of the protective cover includes a cover curvature differing from the hook curvature.

6. The assembly of claim 1, wherein the substantially planar section of the protective cover is a flat plane.

7. The assembly of claim 1, further comprising a plurality of hooks forming a hook assembly having an outside diameter, and wherein a diameter of the protective cover is less than the outside diameter of the hook assembly.

8. The assembly of claim 1, further comprising a pellet coupled to a tether, the at least one hook coupled to the pellet.

9. The assembly of claim 8, wherein the pellet includes a head portion having a head diameter, and wherein a diameter of the protective cover is greater than the diameter of the head portion.

10. The assembly of claim 9, wherein the pellet includes a shank portion extending from the head portion, and wherein a diameter of the shank portion is smaller than the head diameter.

11. A grappling assembly for use with an entangling projectile, the grappling assembly comprising:

at least one hook including an apex portion and a sharpened prong extending distally from the apex portion;

a protective cover, positioned adjacent the apex portion of the at least one hook, the protective cover including a substantially flat contact surface;

the protective cover positioned relative to the at least one hook such that the sharpened prong of the at least one hook extends distally from the protective cover and thereby remains exposed relative to the protective cover; and a first pellet coupled to a tether, the at least one hook coupled to the first pellet;

the at least one hook, the first pellet and the protective cover being formed integrally with one another.

12. The assembly of claim 11, further comprising a second pellet coupled to an end of the tether opposing an end to which the first pellet is coupled, and further comprising at least one second hook and one second protective cover formed integrally with one another.

13. The assembly of claim 11, wherein the protective cover forms a substantially continuous contact surface.

14. The assembly of claim 1, further comprising a plurality of hooks, each of the plurality of hooks having an apex portion, the protective cover positioned adjacent each apex portion of each of the plurality of hooks.

15. The assembly of claim 14, wherein each of the plurality of hooks has a cross-sectional area at the apex portion, and wherein the substantially flat contact surface of the protective cover includes a cross-sectional area greater than a combined cross-sectional area of the apex portions of the plurality of hooks.

16. The assembly of claim 11, wherein the at least one hook has a hook curvature, and wherein the substantially flat contact surface of the protective cover includes a cover curvature differing from the hook curvature.

17. The assembly of claim 11, further comprising a plurality of hooks forming a hook assembly having an outside diameter, and wherein a diameter of the protective cover is less than the outside diameter of the hook assembly.

18. The assembly of claim 11, wherein the first pellet includes a head portion having a head diameter, and wherein a diameter of the protective cover is greater than the diameter of the head portion.

19. The assembly of claim 18, wherein the first pellet includes a shank portion extending from the head portion, and wherein a diameter of the shank portion is smaller than the head diameter.

* * * * *